US005431278A

United States Patent [19]

Gretz

[11] Patent Number: 5,431,278

[45] Date of Patent: Jul. 11, 1995

[54] GOLF BAG WITH ADHESIVELY SECURED DIVIDER PANELS AND ADHESIVELY SECURED TUBULAR BODY

[75] Inventor: Jon J. Gretz, Springfield, Tenn.

[73] Assignee: Wilson Sporting Goods Co., Chicago, Ill.

[21] Appl. No.: 140,874

[22] Filed: Oct. 25, 1993

[51] Int. Cl.[6] ..... A63B 55/00

[52] U.S. Cl. ..... 206/315.6; 206/315.8

[58] Field of Search ..... 206/315.2–315.8

[56] References Cited

U.S. PATENT DOCUMENTS

| | | | |
|---|---|---|---|
| 2,436,688 | 2/1948 | Corbett | 206/315.3 |
| 2,938,559 | 5/1960 | Harkrader | 206/315.6 |
| 3,147,786 | 9/1964 | Kish, Jr. | 206/315.8 |
| 3,230,992 | 1/1966 | Kish, Jr. | 206/315.3 X |
| 4,055,207 | 10/1977 | Goodwin | 206/315.6 |
| 4,194,547 | 3/1980 | Sidor et al. | 206/315.6 |
| 4,509,643 | 4/1985 | Rhee | 206/315.6 |
| 4,667,820 | 5/1987 | Solheim | 206/315.6 |
| 4,685,561 | 8/1987 | Reimers | 206/315.3 X |
| 4,691,823 | 9/1987 | Pape | 206/315.6 |
| 4,796,752 | 1/1989 | Reimers | 206/315.3 |
| 4,967,904 | 11/1990 | Quellais et al. | 206/315.3 |
| 5,148,915 | 9/1992 | Ryan | 206/315.6 |
| 5,215,194 | 6/1993 | Blanford et al. | 206/315.3 |

FOREIGN PATENT DOCUMENTS

| | | | |
|---|---|---|---|
| 254609 | 5/1963 | Australia | 206/315.4 |
| 207317 | 11/1923 | United Kingdom | 206/315.5 |
| 2256808 | 12/1992 | United Kingdom . | |

*Primary Examiner*—Sue A. Weaver

[57] ABSTRACT

A golf bag includes an elongated tubular body, a base secured to the bottom of the tubular body, and a top cap secured to the top of the tubular body. The top cap includes divider walls which provide a plurality of club openings, and each divider wall has a channel which opens toward the base. The top of a divider panel is adhesively secured within each channel, and the bottom of the divider panel is secured to the base. The tubular body includes a flexible panel which is formed into a tube, and the overlapping edge of the panel are adhesively secured.

13 Claims, 3 Drawing Sheets

GOLF BAG WITH ADHESIVELY SECURED DIVIDER PANELS AND ADHESIVELY SECURED TUBULAR BODY

BACKGROUND

This invention relates to golf bags, and, more particularly, to a golf bag with adhesively secured club divider panels and an adhesively secured tubular body.

Golf bags commonly include a top cap with divider walls which form separate compartments for groups of clubs. In order to protect the shafts and grips of the clubs, some golf bags are also equipped with divider panels which extend from the top cap to the bottom of the bag to provide separate club compartments throughout the length of the bag. The divider panels can be attached to the divider walls of the top cap by riveting, by looping the divider panel over the divider walls and stitching or stapling the panels, etc.

In order to provide increased protection to golf clubs, some golf bags include a relatively stiff or rigid tube which surrounds the clubs. The tube can be provided by forming a sheet of material into a cylinder with overlapping ends and then securing the overlapped ends by stitching or riveting.

SUMMARY OF THE INVENTION

The invention provides new methods for securing the divider panels and the cylindrical tubular body of a golf bag. The divider panels are adhesively secured within grooves in the bottoms of the divider walls so that the divider panels extend downwardly from the divider walls without any visible attaching structure which could scrape the clubs or the golfer's hands or which affect the appearance of the bag. The overlapping ends of the tubular body are adhesively secured with a strip of double-sided adhesive.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
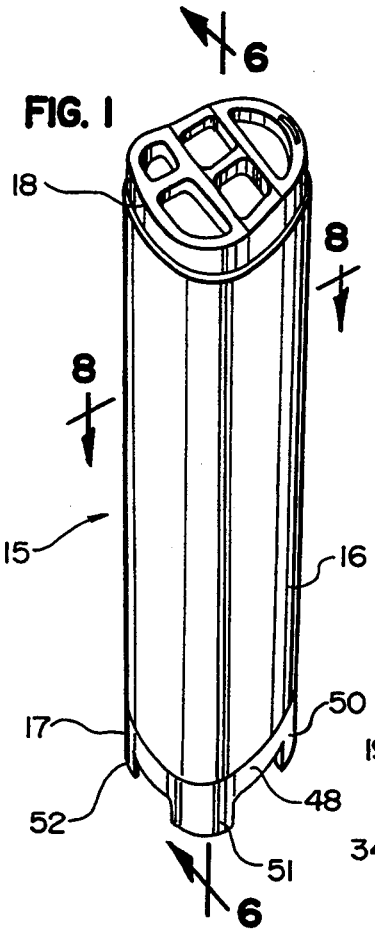
FIG. 1 is a perspective view of a golf bag formed in accordance with the invention.
Figure 2:
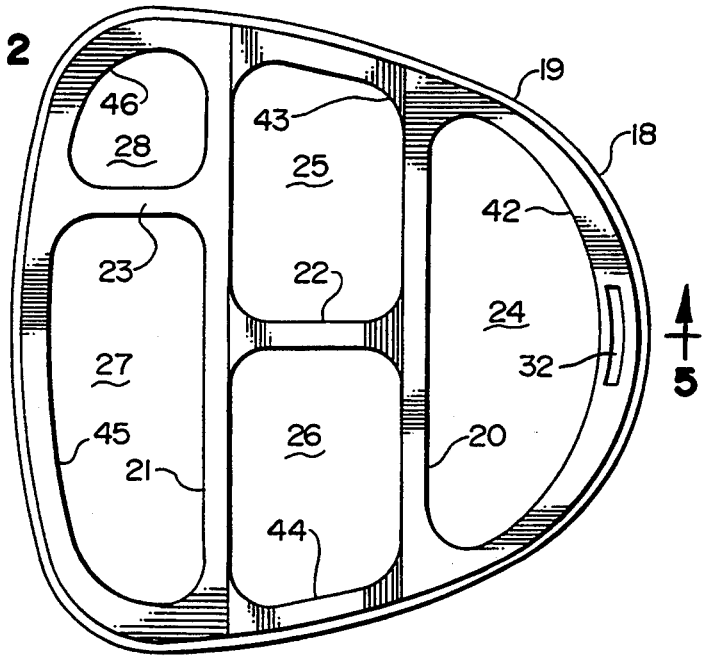
FIG. 2 is a top plan view of the golf bag.

Referring to FIG. 1, a golf bag 15 includes a tubular body 16, a base 17 which closes the bottom end of the body, and a top cap 18. The top cap 18 includes a somewhat D-shaped side wall 19 in top plan view (FIG. 2), a pair of transverse divider walls 20 and 21, and a pair of fore-and-aft divider walls 22 and 23. The divider walls provide openings 24, 25, 26, 27, and 28 for one or more golf clubs.

Figure 3:
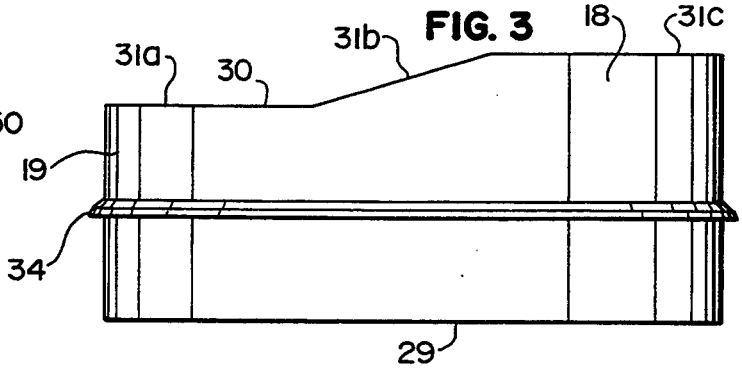
FIG. 3 is a side elevational view of the top cap of the golf bag.

Referring to FIG. 3, the side wall 19 includes a bottom edge 29 and a top edge 30 which includes a first portion 31*a* which is parallel to the bottom edge, an incline portion 31*b*, and a third portion 31*c* which is parallel to the bottom edge. The top edge of the club opening 24 is thereby spaced farther from the base 17 than the other club openings, and the opening 24 is intended for the longer clubs such as wood-type clubs. The club openings 25 and 26 are suitable for the long and middle irons, the club opening 27 is suitable for the short irons, and the small club opening 28 may be used for a putter. A strap opening 32 is provided adjacent the club opening 24 for attaching a carrying strap.

Figure 5:
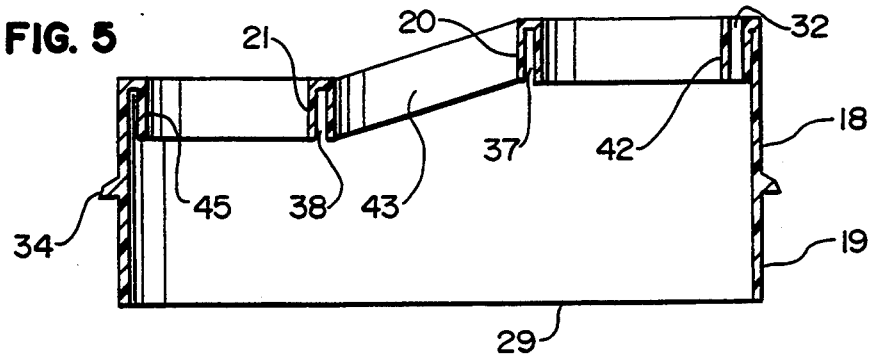
FIG. 5 is a sectional view of the top cap taken along the line 5—5 of FIG. 2.
Figure 6:
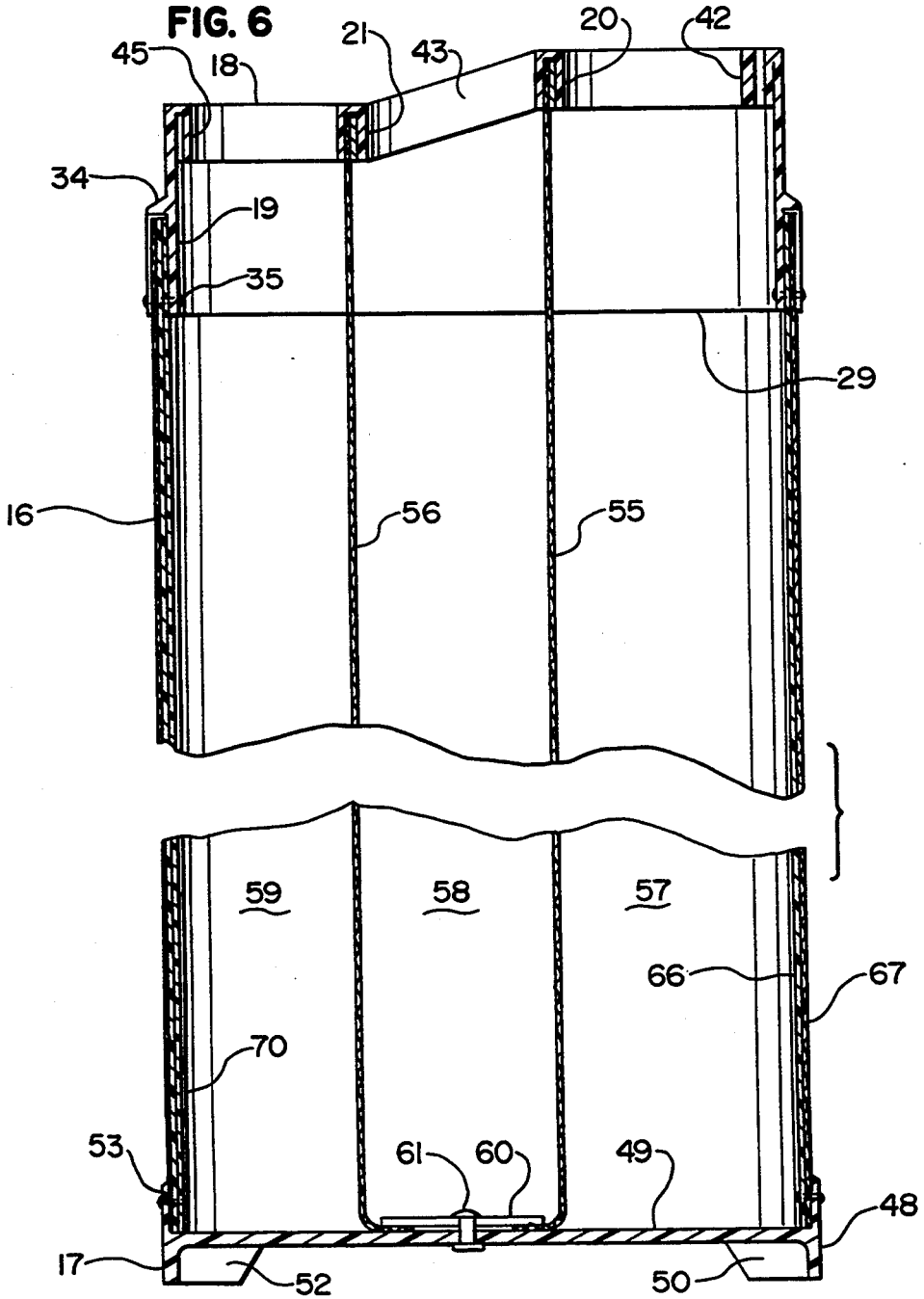
FIG. 6 is a longitudinal sectional view of the golf bag taken along the line 6—6 of FIG. 1.

Referring to FIGS. 3, 5, and 6, the side wall 19 includes an outwardly extending shoulder 34 which abuts the top edge of the tubular body 16. The tubular body can be attached to the side wall 19 below the shoulder by any suitable means, for example, adhesive, rivets, stitching, etc. In the embodiment illustrated in FIG. 6, the tubular body is attached by stitches 35.

Figure 4:
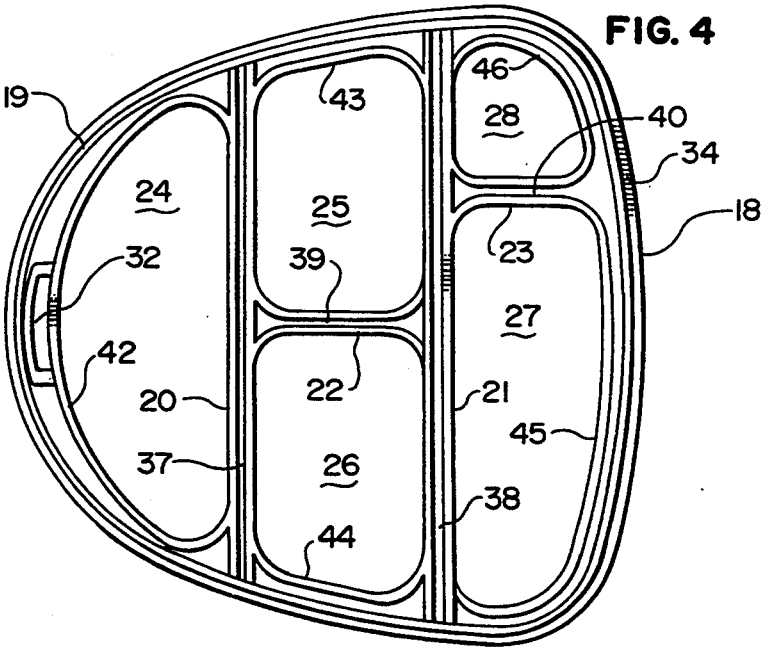
FIG. 4 is a bottom plan view of the top cap.

Referring to FIGS. 4 and 5, each of the divider walls is generally channel-shaped and includes a groove, recess, or trough which opens toward the bottom of the bag. The transverse divider walls 20 and 21 include grooves 37 and 38, and the fore-and-aft divider walls 22 and 23 include grooves 39 and 40. The top cap also includes curved inside walls 42, 43, 44, 45, and 46 which merge with the divider walls and which define portions of the club openings. The top cap is advantageously injection molded from plastic, for example, polypropylene.

Referring to FIGS. 1 and 6, the base 17 includes a generally D-shaped side wall 48, a bottom wall 49, and three feet 50, 51, and 52 which project downwardly from the bottom wall. The bottom edge of the tubular body 16 is supported by the bottom wall 49, and the tubular body is attached to the side wall 48 by stitching 53 or by other suitable fasteners, such as adhesive or rivets. The base is also advantageously injection molded from polypropylene.

Figure 8:
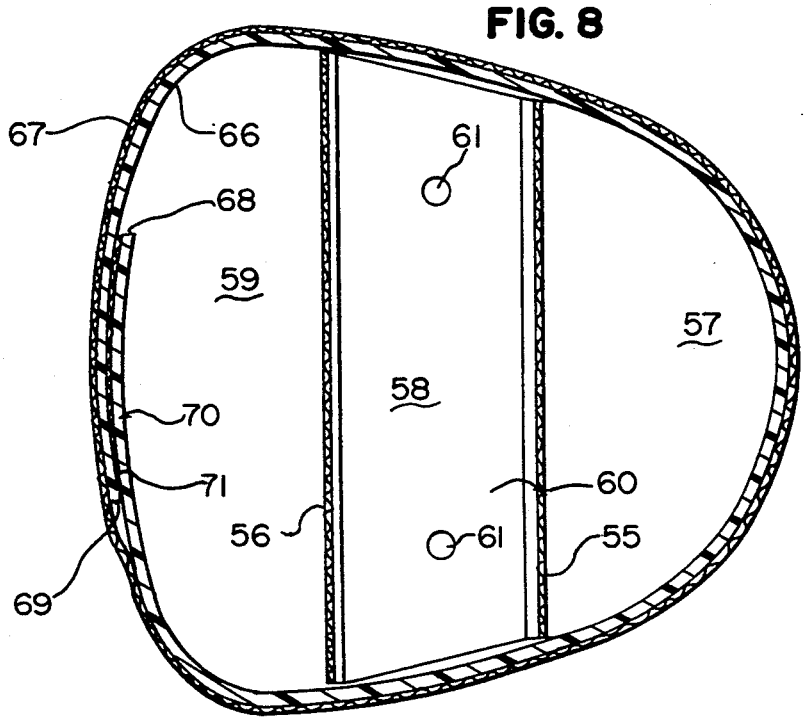
FIG. 8 is a transverse sectional view taken along the line 8—8 of FIG. 6.

Referring to FIGS. 6 and 8, a pair of divider panels 55 and 56 are attached to the transverse divider walls 20 and 21 of the top cap and to the bottom wall 49 of the base. The divider panels extend longitudinally along the full length of the golf bag and form three longitudinally extending club compartments 57, 58, and 59. The divider panels 55 and 56 can be conveniently formed from flexible sheets of nylon fabric. The bottom end of each of the divider panels may be secured to the bottom wall 49 by an attaching panel 60 which is attached to the bottom wall by a pair of rivets or studs 61. The attaching sheet 60 is advantageously formed from polypropylene, and the bottom ends of the divider panels can be attached to the bottom surface of the panel 60 by stitching or the like.

Nylon divider sheets which are attached to the bottom of a golf bag in the manner illustrated in FIG. 6 are known in the prior art. However, the manner of attaching the upper ends of the divider sheets to the divider walls 20 and 21 is new and unique.

Figure 7:
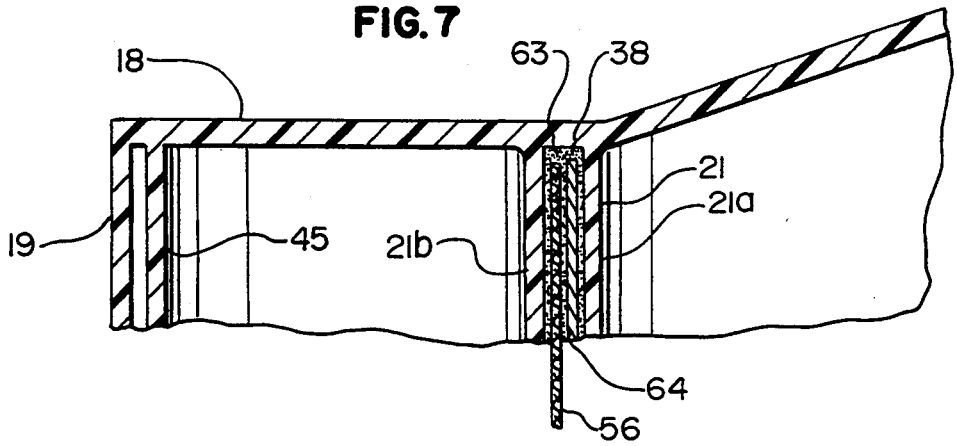
FIG. 7 is an enlarged fragmentary view of a portion of FIG. 6.

Referring to FIG. 7, the channel-shaped divider wall 21 includes a pair of parallel side walls 21*a* and 21*b* which define the channel 38. The nylon sheet 56 which forms the divider panel is secured within the channel 38 by adhesive 63. A more secure adhesive attachment of the nylon sheet within the channel can be provided by first attaching a fibrous panel 64 to the upper end of the nylon sheet. The fibrous panel 64 provides additional thickness and body to the nylon sheet, and the adhesive flows into the pores of the fibrous panel to provide a secure mechanical attachment. In one specific embodiment, a fibrous panel sold under the name Texon, which is similar to fiber board, was used.

The divider panels are attached to the top cap before the top cap is attached to the tubular body. The top cap is inverted so that the channels 37 and 38 in the divider walls 20 and 21 open upwardly. Each channel is then filled about half way with adhesive. In one specific embodiment hot melt adhesive from 3M was applied to the channels by a hot melt applicator. Before the adhesive is allowed to cool and harden, the nylon divider sheet 56 and the attached fibrous panel 64 are inserted into the channel. The adhesive is forced to flow upwardly along the sides of the nylon sheet and fibrous panel to substantially fill the channel. The adhesive is compatible with the nylon sheet and the plastic of the top cap and forms an adhesive attachment with the nylon and the top cap when the adhesive cools. Thereafter, the top cap can be secured to the tubular body and the bottom ends of the nylon sheet can be attached to the bottom wall of the base in the conventional manner.

The divider panels are attached to the divider walls completely internally of the divider walls, and no exterior attachments are visible which might interfer with the appearance of the golf bag or which could result in projections which could scrape the golf clubs or the golfer's hands when golf clubs are inserted or removed or when the golf bag is lifted by grasping the divider walls.

The tubular body 16 of the golf bag can be formed from a sheet of flexible fabric such as nylon. In that event, longitudinal stays, for example, wire rods, extends between the base 17 and the top cap 18 for maintaining the separation between the base and the top cap and maintaining the generally tubular shape of the body.

The particular golf bag illustrated includes an inner tube 66 (FIGS. 6, 8, and 9), and an outer tube or cover 67 which surrounds the inner tube. The inner tube 66 is formed from a flexible panel or sheet of relatively stiff material compared to the cover 67 and provides the golf bag with a relatively rigid tubular body which provides additional protection to the golf clubs. For example, the inner tube 66 can be formed from a sheet of polyethylene, and the cover 67 can be formed from a sheet of nylon.

Referring to FIG. 8, the sheet which forms the inner tube 66 includes a pair of longitudinally extending edges 68 and 69, and the sheet is formed into a generally cylindrical shape so that the edges 68 and 69 overlap to form an overlapped portion 70 of double thickness. In the past the overlapped portion of such tubular bodies were secured by stitching, riveting, or the like. In accordance with this invention, however, the overlapped portion 70 is secured by a strip of double-sided adhesive 71. In one specific embodiment of the invention, the tube 66 was formed from polyethylene, and the adhesive 71 was obtained from 3M under the designation 3M 969. 3M 969 is a strip of pure adhesive, i.e., adhesive without a carrier sheet, and both sides of the strip are suitable for adhesive bonding. The strip is provided in a roll form, and the windings of the roll are separated by a release liner which is removed as the strip is unwound. The adhesive is tacky at room temperature. The strip is adhesively secured to one edge portion of the sheet which forms the inner tube 66, and the other edge portion is brought into overlapping relationship to form the overlapped portion 70 and is adhesively secured to the other surface of the adhesive strip.

Figure 9:
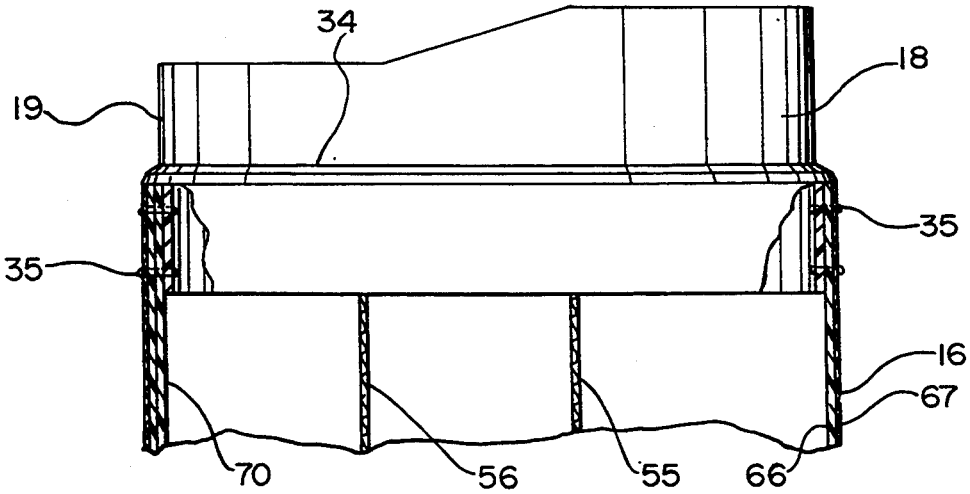
FIG. 9 is a side elevational view, partially broken away, showing the attachment of the tubular body to the top cap.

The adhesively secured inner tube 66 can be attached to the base 17 and the top cap 18 by any suitable means, for example, adhesive, rivets, or stitching. Although stitching 35 is illustrated in FIGS. 6 and 9, I have also used urethane adhesive/sealant for attaching the inner tube 66 to the base and top cap.

The outer tube or cover 67 surrounds the inner tube and may also be attached to the base and top cap by the same attachment means. The outer tube 67 reinforces the adhesive attachment of the overlapped portion 70 of the inner tube and restrains the tendency of the cylindrically formed overlapped portions to separate. Further securement of the overlapped portion can be provided by aligning the overlapped portion with the area in which the conventional handle and bag strap are attached to the bag so that the conventional rivets which attach the handle and bag strap can be inserted through the overlapped portion.

While the particular bag illustrated in the drawing includes both the adhesively secured divider panels and the adhesively secured inner tubular body, it will be understood that a golf bag may include only one of those features. For example, a golf bag can be provided with adhesively secured divider panels and a flexible tubular body which is supported by stays. Alternatively, a golf bag can include the adhesively secured inner tubular body 66 without the divider panels. For example, the relatively rigid inner tubular body is particularly suitable for use with golf bags which include individual tubes into which each club is inserted. The tubes are confined within and protected by the relatively rigid tubular body.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A golf bag comprising:

an elongated tubular body having top and bottom ends, a base secured to the bottom end of the tubular body, a top cap secured to the top end of the tubular body, the top cap having an outer wall which extends around the top of the tubular body and at least one divider wall which extends across the outer wall and provides a plurality of club openings in the top cap, the divider wall having a channel which faces toward the base, and an elongated divider panel within the tubular body and having a top end which is adhesively secured within the channel in the divider wall and a bottom end which is secured to the base.

2. The golf bag of claim 1 in which the divider panel includes an elongated sheet which extends between the top cap and the base and a strip of porous material which is secured to the top end of the sheet, both the top end of the sheet and the strip of porous material being adhesively secured within the channel in the divider wall.

3. The golf bag of claim 2 in which the strip of porous material is fiber board.

4. The golf bag of claim 2 in which the sheet is nylon.

5. The golf bag of claim 1 in which said tubular body includes a flexible panel having a pair of longitudinal edges overlapping and being adhesively secured to each other, the top and bottom end of the tubular body respectively including a top and bottom of the tube which are secured to the top cap and the base, respectively.

6. The golf bag of claim 5 in which said tubular body also includes an outer cover over said tube, the cover being secured to the top cap and the base.

7. The golf bag of claim 6 in which the flexible panel is formed from polyethylene.

8. The golf bag of claim 7 in which the cover is formed from nylon.

9. A golf bag comprising:

an elongated tubular body having top and bottom ends, a base secured to the bottom end of the tubular body, a top cap secured to the top end of the tubular body, the top cap having an outer wall which extends around the top of the tubular body and a pair of divider walls which extend across the outer wall and provide a plurality of club openings in the top cap, each of the divider walls having a channel which faces toward the base, a pair of elongated divider sheets within the tubular body, each of the divider sheets having a top end which is inserted within the channel of one of the divider walls and a bottom end which is secured to the base, and a pair of strips of porous material, each strip of porous material being secured to the top end of one of the sheets, the top end of each sheet and the attached strip of porous material being adhesively secured within the channel of one of the divider walls.

10. The golf bag of claim 9 in which said tubular body includes a flexible panel having a pair of longitudinal edges, the panel being formed into a tube with the longitudinal edges overlapping and being adhesively secured to each other, the top and bottom end of the tubular body respectively including a top and bottom of the tube which are secured to the top cap and the base, respectively.

11. A golf bag comprising an elongated tubular body having top and bottom ends, a base secured to the bottom end of the tubular body, and a top cap secured to the top end of the tubular body, the improvement comprising said tubular body including a flexible panel having a pair of longitudinal edges, the panel being formed into a tube with the longitudinal edges overlapping and being adhesively secured to each other, the top and bottom end of the tubular body respectively including a top and bottom of the tube which are secured to the top cap and the base, respectively.

12. The golf bag of claim 11 in which the flexible panel is formed from polyethylene.

13. The golf bag of claim 12 in which said tubular body also includes an outer cover over said tube, the cover being formed from nylon.

* * * * *